United States Patent [19]

DeVries

[11] 4,206,870

[45] Jun. 10, 1980

[54] PRESSURE RELIEF VALVE

[75] Inventor: Egbert DeVries, Kettering, Ohio

[73] Assignee: Quad Corporation, Highland Park, Ill.

[21] Appl. No.: 968,032

[22] Filed: Dec. 8, 1978

[51] Int. Cl.[2] ..... B65D 33/16

[52] U.S. Cl. ..... 229/62.5; 137/845; 220/209; 229/DIG. 14; 426/118

[58] Field of Search ..... 229/62.5, DIG. 14; 220/209; 426/118, 130, 395, 403, 8; 137/845; 150/9

[56] References Cited

U.S. PATENT DOCUMENTS

| | | | |
|---|---|---|---|
| 2,361,344 | 10/1944 | Yates | 229/DIG. 14 |
| 2,927,722 | 3/1960 | Metzger | 229/62.5 |
| 3,370,780 | 2/1968 | Shaw | 229/62.5 |
| 3,989,182 | 11/1976 | Stearley | 229/DIG. 14 |
| 4,000,846 | 1/1977 | Gilbert | 426/118 |
| 4,042,170 | 8/1977 | Ekman et al. | 150/9 |

FOREIGN PATENT DOCUMENTS

| | | | |
|---|---|---|---|
| 1411644 | 7/1969 | Fed. Rep. of Germany | 229/62.5 |
| 961222 | 6/1964 | United Kingdom | 229/62.5 |

*Primary Examiner*—Stephen P. Garbe

*Attorney, Agent, or Firm*—Fidelman, Wolffe & Waldron

[57] ABSTRACT

A pressure relief valve includes a flexible sheet bonded, except for a series of adhesive-free areas and channels therebetween, to a container having one or more holes in communication with said adhesive-free areas. The adhesive, preferably pressure-sensitive adhesive, is printed on the sheet in a fashion which, when bonded to the container, forms the adhesive-free areas and channels. When a gas pressure, as for example, derived from food generated gases, builds up within the container, the force of the gas exerted on the flexible sheet causes the sheet to bulge, thereby forming a cavity over the adhesive-free area. The gas then seeps through any series of channels in communication with said cavity and is released to the atmosphere. After the internal gas pressure has been relieved, the flexible sheet returns to its original position (flush against the container) thereby preventing the ingress of atmospheric gases.

10 Claims, 7 Drawing Figures

PRESSURE RELIEF VALVE

BACKGROUND OF THE INVENTION

This invention relates generally to packaging of materials, notably foodstuffs such as coffee, or foods laden with gas-producing bacteria, yeasts or molds. More particularly, it concerns a unidirectional flow pressure relief valve which allows controlled release from the package of the internally generated gases and at the same time prevents reversed-flow ingress of the ambient atmosphere through the valve.

Freshly roasted coffee is known to give off carbon dioxide gas over an extended period of time. When roasted coffee has been packaged and sealed in flexible bags fabricated of material generally impervious to passage of gases, the release of gases, notably carbon dioxide, from the packaged coffee causes distortion and bulging of the bag. This bulging can and frequently does cause rupture of the bag along the seams or in the parent material thereby exposing the contents to the ambient atmosphere. Exposure of roasted coffee to the atmosphere causes rapid deterioration in the quality of the coffee which requires, if possible, that storage be terminated and that the product be used relatively soon after exposure.

Other foods which generate gases, such as some cheeses, are similarly affected by deterioration or drying when their sealed container is ruptured.

Many valves have been developed for the release of pressure from a container when prescribed pressure limits are exceeded, but generally, these are too complex and costly to use on mass production items especially in relation to the simple, inexpensive bags used for foodstuff packaging, and in relation to the relatively low unit value of the packaged product itself.

A need for simplicity and low cost has led to the development of many inexpensive valves specifically for application to foodstuff packages such as coffee bags. These applications generally require that the packages remain substantially flat-walled during storage, that small pressure differentials cause actuation of the valve to release internally generated gases, and that the valves be self-sealing to prevent reverse flow of atmospheric gases after release of the internal pressures. U.S. Pat. No. 2,595,708 is illustrative of a vented package using a porous material communicating via an extended passage between the internal and external environments of the package. This device allows venting of food-generated gases but continuously leaves open a passage, albeit restricted, for inflow of atmospheric moisture and gases. U.S. Pat. No. 3,937,396 is illustrative of a valve for a vented package which relies on an internal pressure buildup to distort the flexible package walls to the point where a bonded seal is broken. Breaking the seal exposes an opening which communicates directly, or via an extended passage, between the interior and exterior of the package. This valve relies on the "memory" or resiliency of the material to return the distorted material to its original position after venting relieves the internal pressure. Unfortunately, the bonded seal once broken is not restored. As a consequence backleakage of external atmosphere into the package is not prevented as effectively as in the original sealed condition prior to venting and shelf life of the packaged material is shortened.

SUMMARY OF THE INVENTION

The instant invention is an extremely simple and inexpensive valve suited for application on rigid and flexible containers to provide release of internally generated gases from the container at low inside-outside pressure differentials and to prevent ingress of external atmospheric gases to the container. The valve includes a flexible, generally gas-impervious sheet material bondable to the container. An array of adhesive patches, preferably pressure-sensitive adhesive patches, is printed on the flexible sheet in a pattern such that a group of patches nearly touching end to end forms an adhesive-free area therebetween, wherein the adhesive-free areas so formed are interconnected by narrower adhesive-free channels. Alternatively, the pattern of patches may form a plurality of interconnected adhesive-free channels with no larger adhesive-free areas. The adhesive-printed sheet is bonded to a container in a position such that one or more holes in the container wall are in communication with the adhesive-free areas or channels.

When gas pressure within the container builds up sufficiently, the flexible sheet above the adhesive-free area or channel in communication with the inside of the container raises to allow the exit of gas. This gas then seeps through a series of channels forming a tortuous path to the atmosphere. After the internal gas pressure has been relieved, the flexible sheet returns to its original closed position against the container wall, thereby preventing entry of atmospheric gases.

OBJECTS OF THE INVENTION

An object of the present invention is to provide a pressure relief valve which opens in response to small gas pressure differentials.

A further object of the present invention is to provide a pressure relief valve which, after venting, actively reseals to prevent reverse flow of gases.

Still another object of this invention is to provide a relief valve suited for use with a rigid or non-rigid container.

An additional object of this invention is to provide a valve which is inexpensive to fabricate and apply and is reliable in operation.

Other objects, advantages and novel features of the present invention will become apparent from the following detailed description of the invention when considered in conjunction with the accompanying drawings in which.

DESCRIPTION OF THE INVENTION

Figure 1:
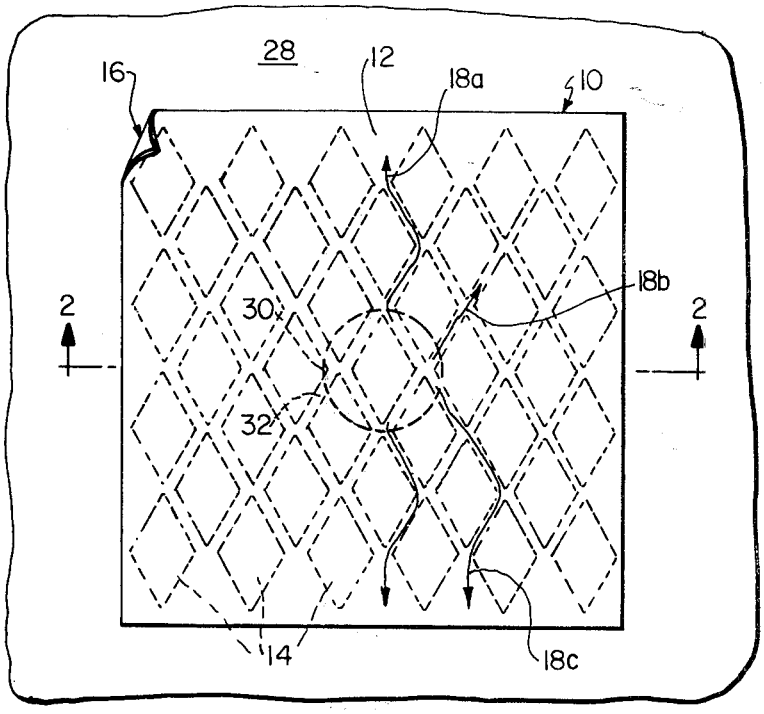
FIG. 1 is a plan view of the pressure relief valve of this invention shown applied to a container wall segment.
Figure 2:
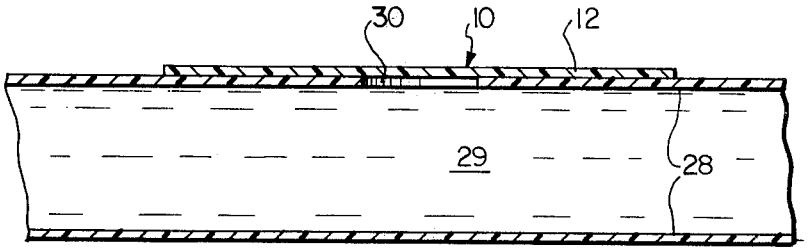
FIG. 2 is a cross-sectional elevation view taken along the line 2—2 of FIG. 1 showing a closed valve.
Figure 3:
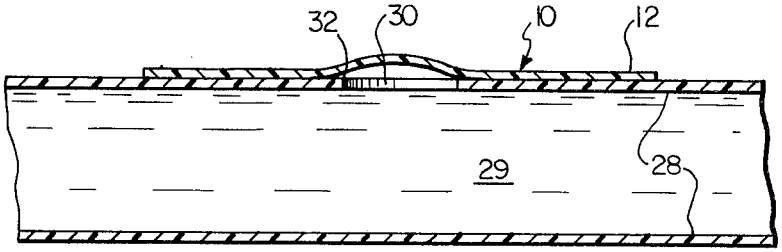
FIG. 3 is a view similar to FIG. 2 showing a cavity formed by the internal gas pressure.

Referring to FIGS. 1–3, the pressure relief valve 10 of this invention is comprised of a thin film or flexible sheet 12 bonded by an array of adhesive patches 14 to the container 28. The patches 14 do not contact each other; the pattern extends over the entire undersurface of the flexible sheet 12. A hole 30 through the container wall 28 is in direct communication with the non-bonded area or channel 32. Paths 18*a*, 18*b*, and 18*c* are representative of the "tortuous paths" through which gas may be released from the package.

The corner 16 of the flexible sheet 12 is shown partially peeled away from the container for the sake of clarity.

The materials used for the flexible sheet 12 are substantially impervious to gas and moisture flow at the pressures normally existing within and outside a package incorporating the valve 10 of this invention.

When gas pressure builds up, for example, by release of gas from packaged products 29 within the container to be vented, the gas exerts a local force via the hole 30 on the flexible sheet 12 in the region of the non-bonded area or channel 32 which causes the sheet to bend outward in that region. The gas within the cavity so formed then slowly passes through a series of channels forming tortuous paths 18 to the atmosphere. After pressure in the container has been relieved the flexible sheet 12 returns to its original closed position.

It should be noted that deflection of the container itself is not an element in the operation of the pressure relief valve 10 of this invention. Consequently, the valve 10 may be bonded to either flexible (FIG. 4) or rigid container walls (FIG. 5) with equal effectiveness.

Figure 4:
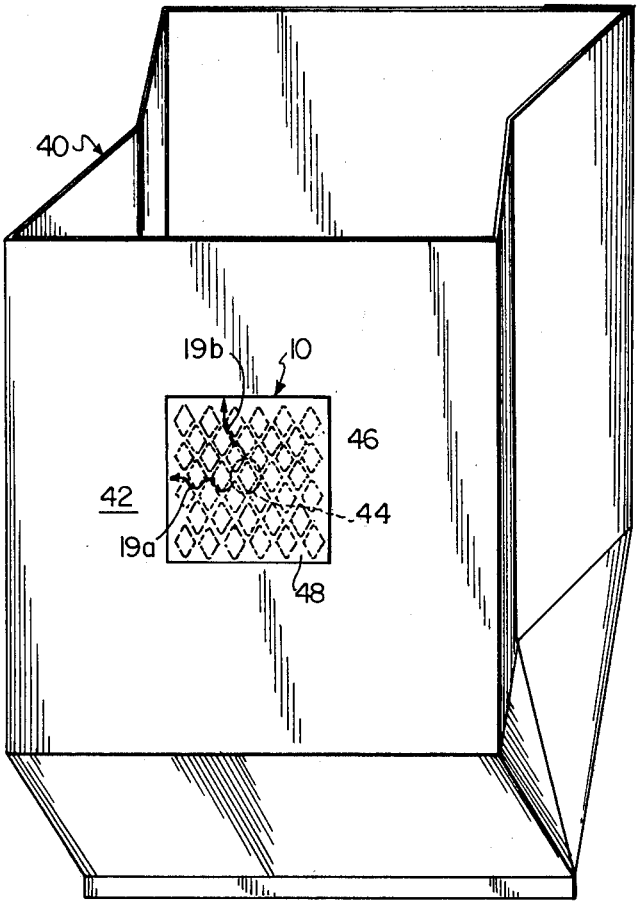
FIG. 4 is a perspective view of a flexible coffee bag with the pressure relief valve of this invention applied thereto.

Referring now to FIG. 4, the pressure relief valve 10 of this invention is incorporated into a coffee bag 40. As incorporated, the flexible sheet 48 of the valve 10 is bonded to the outer surface 42 of the bag 40. The flexible coffee bag itself is generally formed from a plurality of plastic film laminates, the inner one of which is generally of a thermosealing material. In the embodiments shown in FIG. 4, the container 40 is a gussetted bag, wherein the seams are completely thermosealed.

The bag 40 includes an opening 44 in communication with the non-bonded area or channel 46 in the pressure relief valve 10 so that when the pressure relief valve 10 is attached to the outer surface 42 of the coffee bag 40, the pressure relief described above may be effected through the opening 44 and any tortuous path 19. In this embodiment when the roasted coffee beans or ground coffee is stored within the coffee bag 40 and $CO_2$ is released or generated therefrom, the pressure built up within the sealed coffee bag 40 is relieved by the pressure relief valve 10 in the manner described above.

It is believed, however, that the pressure relief valve 10, as described above, will have many additional applications wherein fine control of pressure built up within an enclosed volume is desired in combination with prevention of reverse flow of any gas or fluids into that enclosed volume.

In a particular embodiment of the pressure relief valve 10 of this invention which performed satisfactorily on coffee bags similar to those illustrated in FIG. 4, the sheet 48 was a film of Saran (polyvinylidene chloride) having a thickness approximating 0.002 inches, bonded to a container 40 of the same Saran material. The Saran film was flexible and inelastic. The sides of the diamond-shaped patches were approximately one-half inch in length; tips of the patches were about one-eighth inch apart. The valve 10 was approximately two inches square.

However, it should be noted that any flexible and substantially gas impervious material will be suited for fabrication of a valve 10 of this invention. The valve 10 may be of any desired shape, such as rectangular, circular, elliptic, etc., and the area may vary from about one square inch to about twenty-five square inches. Patches 14 may be from about $\frac{1}{8}$ to $\frac{3}{4}$ inch along one side (or, if circles, in diameter) and spacing between nearly touching patches may be from about 15 to 30% of the length of a side (or diameter).

Figure 5:
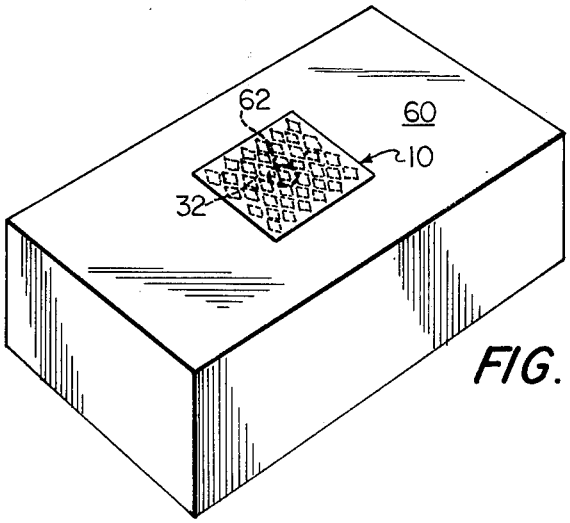
FIG. 5 is a perspective view of a rigid container with the pressure relief valve affixed thereto.

FIG. 5 illustrates the relief valve 10 of this invention applied to the wall of a rigid container 60. As in the coffee bag embodiment described above a hole 62 in the container wall communicates with the non-bonded area or channel 32 in the valve 10.

Figure 6:
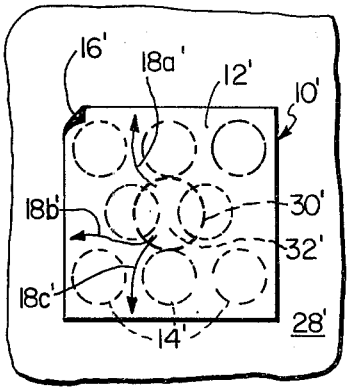
FIGS. 6 and 7 are alternative embodiments of the valve of this invention.

FIG. 6 illustrates an alternative embodiment of this invention wherein the valve 10′ includes an array of circular-shaped patches 14′ bonding together the flexible sheet 12′ and the container 28′. (Throughout, prime markings (′) are used to reference similar parts.) This embodiment provides for smaller non-bonded areas 32′ relative to adhesive patches 14′. This reduces the rate of venting from the container 28′.

Figure 7:
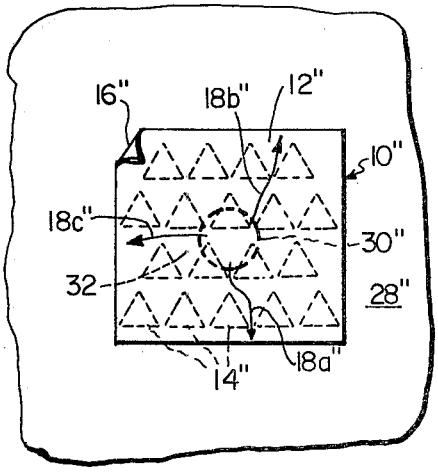

FIG. 7 illustrates another embodiment of this invention wherein an array of triangular-shaped patches 14″ are used. In contrast to the embodiments of FIGS. 1 and 6, the valve 10″ of FIG. 7 comprehends a design in which three patches join at each channel of any tortuous path 18″. This effectively reduces the rate of venting from valve 10″ compared to the rate of the valve 10 of FIG. 1.

Other alternative embodiments fall within the scope of this invention and the pressure relief valve should not be considered as limited to the examples presented above. For example, in alternative embodiments the shape, size, and spacing of the adhesive patches may be varied as necessary for effective venting. Adhesive patches 14 may also be stars, rectangles, polygons, etc., and any combination of shapes may be used in one valve. The number of holes in communication with the non-bonded areas or channels of the valve need not be limited to one, two or any particular quantity. Further, the hole 30 need not be centered within the non-bonded area 32. In fact, in a particularly effective embodiment, hole 30 may be larger than one adhesive patch, in which case centering hole 30 over a non-bonded area 32 is no problem. Attachment of the valve to the container is simply faster and cheaper than in the case where the hole is smaller than one adhesive patch. It should also be noted that, in embodiments wherein only narrow adhesive-free channels are found (no larger adhesive-free areas), the hole 30 need be in communication with at least one channel.

Additionally, any film or lamination which exhibits a low gas permeability can be used as material for the flexible sheet 12. A particularly effective embodiment of the instant invention involves the use of Saran, that is polyvinylidine chloride, as the material for both the flexible sheet 12 and the container 28. The electrostatic attraction between these two Saran materials and the "tortuous path" design using pressure-sensitive adhesive will combine to form still another effective one-way valve.

Also, it should be understood that the valve 10 of this invention is suitable for packages of any stored material (i.e. not limited to food products), such as chemical materials, which might evolve gases during shipment or storage. Sealed non-rigid packages of materials which do not evolve gases may also utilize the valve of this invention where a negative change of external pressure on the package is anticipated, e.g. at high altitude, and the container has been sealed with some gas already within it.

What is claimed:

1. A pressure relief valve for application to the outside wall of a container for controlling the pressure within said container, comprising:

a finite flexible sheet, said sheet being impervious to gas at low pressure differentials, and an array of adhesive patches bonding said sheet to the container wall and forming a plurality of adhesive-containing and adhesive-free areas, said adhesive-free areas patterned to define channels communicating between the interior and the exterior of said container through an opening in said wall, said opening being larger than one of said adhesive patches, and wherein said array forms a tortuous path of at least one channel through which gas must pass before release from said container, whereby, in response to a build-up of internal gas pressure, the part of the flexible sheet above the adhesive-free area adjacent the opening in said container wall raises to allow exit of the gas through said tortuous paths, and upon relief of the internal gas pressure, said flexible sheet returns to its original closed position to prevent ingress of atmospheric gases.

2. The pressure relief valve of claim 2, wherein said tortuous path is defined by at least two channels.

3. The pressure relief valve of claim 2, wherein said sheet is polyvinylidene chloride.

4. The pressure relief valve of claim 2, wherein said adhesive patches are diamond-shaped.

5. The pressure relief valve of claim 2, wherein said adhesive patches are triangular-shaped, and wherein three such patches are arranged tip to tip in close proximity to one another so as to form a triangular-shaped adhesive-free area therebetween.

6. The pressure relief valve of claim 2 wherein said adhesive patches are circular shaped.

7. The pressure relief valve of claim 2, wherein said container is a sealed coffee bag.

8. The pressure relief valve of claim 2, wherein said adhesive is pressure-sensitive.

9. The pressure relief valve of claim 2, wherein said channels are from about 15 to about 30% of a major dimension of said adhesive patches.

10. The pressure relief valve of claim 2, wherein said adhesive patches are patterned to define narrow adhesive-free channels interconnecting other narrow adhesive-free channels, wherein at least one channel communicates with the interior of said container.

* * * * *